US012378490B2

(12) United States Patent
Hochstein et al.

(10) Patent No.: US 12,378,490 B2
(45) Date of Patent: Aug. 5, 2025

(54) BIOACTIVE ADDITIVE FOR A FUEL, USES THEREOF, FUEL COMPOSITION, AND METHOD

(71) Applicant: TUNAP GMBH & CO. KG, Wolfratshausen (DE)

(72) Inventors: Christoph Hochstein, Wolfratshausen (DE); Sabine Riha, Gmund am Tegernsee (DE); Volker Knöthig, Weilheim (DE)

(73) Assignee: TUNAP GMBH & CO. KG, Wolfratshausen (DE)

( * ) Notice: Subject to any disclaimer, the term of this patent is extended or adjusted under 35 U.S.C. 154(b) by 0 days.

(21) Appl. No.: 18/561,250

(22) PCT Filed: May 6, 2022

(86) PCT No.: PCT/EP2022/062325
§ 371 (c)(1),
(2) Date: Nov. 15, 2023

(87) PCT Pub. No.: WO2022/243068
PCT Pub. Date: Nov. 24, 2022

(65) Prior Publication Data

US 2024/0279562 A1 Aug. 22, 2024

(30) Foreign Application Priority Data

May 20, 2021 (EP) ..... 21174966

(51) Int. Cl.
*C10L 1/232* (2006.01)

(52) U.S. Cl.
CPC ..... *C10L 1/232* (2013.01); *C10L 2230/081* (2013.01); *C10L 2230/083* (2013.01)

(58) Field of Classification Search
CPC ..... C10L 1/232; C10L 2230/081; C10L 2230/083; C10L 1/1811; C10L 1/1832; C10L 1/231
(Continued)

(56) References Cited

U.S. PATENT DOCUMENTS 3,393,058 A 7/1968 Oppermann
3,449,095 A * 6/1969 Perilstein ..... C10L 1/232 44/342
(Continued)

FOREIGN PATENT DOCUMENTS

BR 2007000946 A 10/2008
DE 198 42 116 A1 3/2000
(Continued)

OTHER PUBLICATIONS

International Search Report of PCT/EP2022/062325, Aug. 12, 2022, 6 pages.
(Continued)

*Primary Examiner* — Ellen M McAvoy
(74) *Attorney, Agent, or Firm* — Womble Bond Dickinson (US) LLP

(57) ABSTRACT

The present disclosure relates to a bioactive additive, to the use thereof and to a fuel composition containing the additive, as well as to methods in which the additive or the fuel composition are used. The additive comprises at least one compound represented by the general formula (I) given below, wherein R is a saturated or unsaturated hydrocarbon residue having 14 to 20 carbon atoms; and n is an integer of 1 to 6.
(Continued)

(I)

19 Claims, 4 Drawing Sheets

(58) Field of Classification Search
USPC ..... 508/283; 44/342
See application file for complete search history.

(56) References Cited

U.S. PATENT DOCUMENTS

| | | | | |
|---|---|---|---|---|
| 3,927,994 | A * | 12/1975 | Romans | C10L 1/143 44/443 |
| 3,927,995 | A * | 12/1975 | Romans | C10L 1/143 252/392 |
| 5,024,677 | A * | 6/1991 | Wang | C10L 1/22 44/451 |
| 5,035,720 | A | 7/1991 | Weers | |
| 6,083,288 | A * | 7/2000 | Wolf | C10L 1/14 44/342 |
| 2001/0021711 | A1 | 9/2001 | Beilfuss et al. | |
| 2002/0058684 | A1 | 5/2002 | Beilfuss et al. | |
| 2005/0054642 | A1 | 3/2005 | Gradtke et al. | |
| 2006/0223806 | A1 | 10/2006 | Gradtke et al. | |
| 2007/0051033 | A1* | 3/2007 | Martin | C10L 10/04 44/342 |
| 2007/0193110 | A1* | 8/2007 | Schwab | C10L 10/08 44/389 |
| 2012/0110899 | A1 | 5/2012 | Beilfuss et al. | |
| 2013/0227878 | A1* | 9/2013 | Wolf | C10L 1/2387 44/434 |
| 2015/0113858 | A1* | 4/2015 | Brewer | C10L 1/232 44/345 |
| 2020/0248089 | A1* | 8/2020 | Shanahan | C10L 1/232 |
| 2021/0388279 | A1* | 12/2021 | Delorme | C10L 10/06 |
| 2022/0195321 | A1 | 6/2022 | Odagiri et al. | |

FOREIGN PATENT DOCUMENTS

| | | | |
|---|---|---|---|
| DE | 199 61 621 | A1 | 7/2001 |
| DE | 103 40 830 | A1 | 4/2005 |
| DE | 10 2007 008 532 | A1 | 8/2007 |
| DE | 10 2009 033 161 | A1 | 1/2011 |
| EP | 0 330 416 | A1 | 8/1989 |
| EP | 1 512 323 | A1 | 3/2005 |
| EP | 1 800 539 | A1 | 6/2007 |
| PL | 223031 | B1 | 9/2016 |
| WO | WO 01/41570 | A2 | 6/2001 |
| WO | WO 2009/060057 | A2 | 5/2009 |
| WO | WO 2011/006734 | A2 | 1/2011 |
| WO | WO 2013/101256 | A2 | 7/2013 |

OTHER PUBLICATIONS

Extended European Search Report of EP 21174966.8, Nov. 16, 2021, 10 pages.

Stanik, Winicjusz et al., "Fuel lubricity modifier", retrieved from STN, abstract No. Database accession No. 2017:1672597, Retrieved from CA [online]: URL: Chemical Abstracts Service, Columbus, Ohio, US, XP002804532 (On Order).

& Stanik, Winicjusz et al., "Fuel lubricity modifier", Pol., 10PP. Coden: POXXA7, Dec. 31, 2017 (Dec. 31, 2017) (On Order).

De Assis, Francisco Antonio, "Additive for internal combustion engines", retrieved from STN, abstract No. Database accession No. 2009:272426, Retrieved from CA [online]: Url: Chemical Abstracts Service, Columbus, Ohio, US, XP002804533 (On Order).

& De Assis, Francisco Antonio, "Additive for internal combustion engines", Braz. Pedido PI, 6PP. Coden: BPXXDX, Dec. 31, 2009 (Dec. 31, 2009) (On Order).

Brazilian Office action for Application No. 112023023507-3, dated Apr. 8, 2025, 7 pages.

* cited by examiner

| | TUNAP active ingredient (1903078)* | TUNAP Proctection System Diesel 1903391 (1000 ppm AI) | TUNAP Proctection System Diesel 1903391 (2500 ppm AI) | TUNAP 685 (Protezione Diesel) 1903078 (1000ppm) | Competitor with BIT | blank |
|---|---|---|---|---|---|---|
| 30 min | 1,00E+04 | 1,00E+04 | 3,90E+03 | 1,00E+04 | 2,80E+04 | 3,00E+04 |
| 7 days | 0 | 0 | 0 | 0 | 1,10E+05 | 1,40E+05 |
| 28 days | 0 | 0 | 0 | 0 | 1,80E+06 | 3,10E+06 |

*= Values from 1st ASTM test

*= Values from 1st ASTM test. The blank of the 1st examination averaged 3.3 E+08 after 30 min.

BIOACTIVE ADDITIVE FOR A FUEL, USES THEREOF, FUEL COMPOSITION, AND METHOD

CROSS-REFERENCE TO RELATED APPLICATIONS

The present application is a U.S. national phase of International Application No. PCT/EP2022/062325 filed 6 May 2022 which designated the U.S. and claims priority to European Patent Application No. 21 174 966.8 filed 20 May 2021, the entire contents of each of which are hereby incorporated herein by reference.

FIELD OF DISCLOSURE

The present disclosure relates to a bioactive additive for a fuel, zo uses of the additive, to a fuel composition containing the additive, and to methods in which the additive or the fuel composition are used. In particular, the additive may be provided for stabilization and/or protection against germination of a fuel.

BACKGROUND

In tanks or other facilities filled with fuels (propellants, combustibles), the combined effect of long storage times, different compositions of the fuel, bio-content in the fuel and external influences such as the formation of condensation water, oxidative and microbiological processes can change the composition of the fuel and lead to undesirable consequences. For example, turbidity up to precipitation (so-called "diesel bug" or "sludge") and clogging of filters but also corrosion and material erosion can occur, which not only impairs the further use of the fuel but can also lead to equipment failure and costly repairs. This affects both stationary and mobile fuel processing equipment and tanks. The increasing bio content in fuels exacerbates the problems described above.

Biocidal compositions for fuels and combustibles are known from the prior art, as described in DE 10 2009 033161 A1, DE 103 408 30 A1, DE 199 61 621 A1, WO 2009/060057 A2, DE 198 42 116 A1, WO 2011/006734 A2, EP 1 800 539 A1, EP 0 330 416 A1, EP 1 512 323 A1, WO 01/41570 A2, among others. For example, DE 103 408 30 A1 discloses a composition based on formaldehyde depot compounds and antioxidants. Often, the conventional compositions contain the biocide 3,3-methylenebis (5-methyloxazolidine) (MBO) as an active ingredient.

However, such biocide-containing compositions or the biocides contained therein are toxic and carcinogenic and consequently must also bear a corresponding hazardous substance label, so that their handling is dangerous and sale to the end customer or end user is not possible, but rather prohibited.

There may therefore be a need for a fuel additive that may reduce or ideally prevent the disruptive effects described above, while itself being non-toxic or carcinogenic.

OBJECT OF THE DISCLOSURE

There may therefore be a need to provide a bioactive additive (or a bioactive additive mixture) for a fuel which has a germicidal effect and does not have toxic or carcinogenic properties. In addition, the additive may also lead to stabilization of the fuel to which it is added and have an anti-corrosive effect.

SUMMARY OF THE DISCLOSURE

The inventors of the present disclosure have carried out extensive studies to solve this problem and have in particular found that certain imidazoline compounds are suitable additives or components for compositions for addition to a fuel for this purpose. In particular, it has been found to be advantageous if the imidazoline compounds have a comparatively hydrophobic moiety and a comparatively hydrophilic imidazoline group substituted with an alkyl hydroxy group, which may impart an amphiphilic character to the compounds. Without wishing to be bound by any theory, the inventors assume that the interaction of the imidazoline group with the amphiphilic character of the compound may contribute significantly to a germicidal as well as an anti-corrosive effect of the additive in a fuel. Surprisingly, when a multifunctional formulation was studied, it was found that the addition of such an imidazoline compound at a higher concentration (e.g., 100 ppm or more to a fuel) was exceptionally effective against the microorganism infestation typical of fuels.

Accordingly, the present disclosure relates to a (bioactive) additive (or additive mixture) for a (preferably liquid) fuel, wherein the additive comprises at least one compound represented by the general formula (I) given below:

(I)

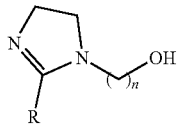

wherein

R is a saturated or unsaturated hydrocarbon residue having 14 to 20 carbon atoms; and n is an integer from 1 to 6.

Furthermore, the present disclosure relates to the use of a compound represented by the general formula (I) given below as a (bioactive) additive for a (preferably liquid) fuel:

(I)

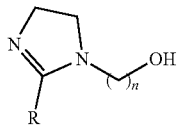

wherein

R is a saturated or unsaturated hydrocarbon residue having 14 to 20 carbon atoms; and n is an integer from 1 to 6.

Furthermore, the present disclosure relates to the use of an additive as described herein for reducing the microbial load of a fuel (in particular for germicidal purposes) and/or for stabilization of a fuel.

Furthermore, the present disclosure relates to a method for reducing microbial load and/or stabilization of a (preferably liquid) fuel, the method comprising adding an additive as described herein to a fuel.

Furthermore, the present disclosure relates to a fuel composition comprising a (preferably liquid) fuel and an additive as described herein.

Further, the present disclosure relates to a method of operating an internal combustion engine in which a fuel composition as described herein is combusted or used as fuel (or in which method an additive as described herein is added to the fuel).

Further objects and advantages of embodiments of the present disclosure will become apparent on the basis of the following detailed description and the accompanying figures.

DETAILED DESCRIPTION OF THE DISCLOSURE

Figure 1:
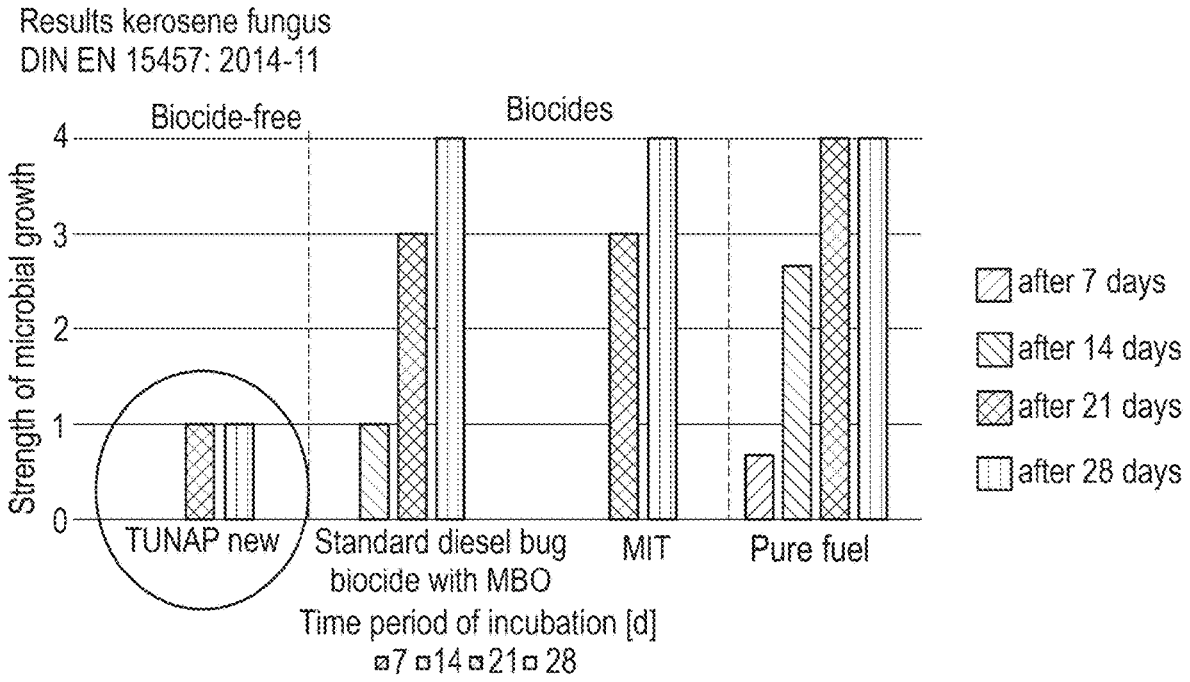
FIG. 1 shows test results on the antimicrobial efficacy of various tested samples against the kerosene fungus *Hormoconis resinae* ATCC 20495, determined according to DIN EN 15457:2014-11.

More details of the present disclosure and further embodiments thereof are described below. However, the present disclosure is not limited to the following detailed description, but is merely illustrative of the teachings according to the present disclosure.

It should be noted that features described in connection with one exemplary embodiment may be combined with any other exemplary embodiment. In particular, features described in connection with an exemplary embodiment of an additive according to the present disclosure may be combined with any other exemplary embodiment of an additive according to the present disclosure, as well as with any exemplary embodiment of a fuel composition according to the present disclosure, as well as any exemplary embodiment of a method according to the present disclosure, as well as any exemplary embodiment of a use according to the present disclosure, and vice versa, unless expressly noted otherwise.

When a term is denoted by an indefinite or definite article, such as "a", "an," and "the" in the singular, this also includes the term in the plural, and vice versa, unless the context clearly specifies otherwise. The expressions "comprise" or "has" as used herein not only include the meaning of "contain" or "include," but may also mean "consist of" and "consist essentially of".

In a first aspect, the present disclosure relates to a bioactive additive (or additive mixture) for a (preferably liquid) fuel.

The term "bioactive" as used herein may in particular mean an antimicrobial activity or an antimicrobial efficacy.

The additive or additive mixture may in particular be a composition, such as a mixture of two, three, four or more components, for addition to a fuel. It may be advantageous if the individual components of the additive form a substantially homogeneous mixture or solution with one another. It may also be advantageous if the additive and the fuel to which the additive is to be added are readily miscible with each other, and in particular form a substantially homogeneous mixture or solution. Even if only an additive is mentioned herein, this may also be understood to mean an additive mixture or a composition for addition to a fuel.

The additive comprises at least one compound (hereinafter also referred to as "imidazoline compound") represented by the general formula (I) given below:

(I)

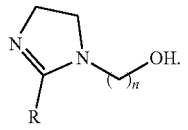

In the general formula (I), R represents a saturated or unsaturated hydrocarbon residue having 14 to 20 carbon atoms. The radical R may be a branched or an unbranched hydrocarbon residue, preferably an unbranched (linear) hydrocarbon residue. The radical R may have one or more double bonds, preferably 1 double bond, i.e. a monounsaturated hydrocarbon residue (for example in a cis-configuration or as a Z-isomer). In an embodiment, R is a saturated or unsaturated hydrocarbon residue having 16 to 18 carbon atoms, for example having 17 carbon atoms.

In the general formula (I), n is an integer from 1 to 6, i.e. the alkyl hydroxy substituent on the imidazoline ring may have from 1 to 6 methylene groups or may be a C1-C6 alkyl hydroxy substituent (branched or unbranched). In an embodiment, n is an integer from 2 to 4, for example 2 or 3, preferably 2.

According to an exemplary embodiment, the additive (or the at least one imidazoline compound) comprises 2-(2-heptadec-8-enyl-2-imidazolin-1-yl)ethanol. This compound has proven to be particularly suitable for use in an additive for a fuel, since it may be used advantageously to achieve a germicidal effect and also an anti-corrosive effect without having toxic or carcinogenic properties.

According to an exemplary embodiment, the additive contains at least 50% by weight of the at least one compound of the general formula (I), for example from 60 to 90% by weight, and may contain up to 100% by weight of the at least one compound of the general formula (I).

According to an exemplary embodiment, the additive further comprises at least one antioxidant. In the context of the present application, an "antioxidant" is understood to mean, in particular, a chemical compound capable of slowing down or (completely) suppressing oxidation of other substances. The addition of an antioxidant may in particular further increase the corrosion-protective effect of the additive.

Suitable examples of the antioxidant include phenols, benzotriazoles, phenylenediamines, and diarylamines. Among the phenols, sterically hindered phenols, cresols or phenol ethers may be particularly suitable, such as butylated hydroxytoluene (BHT, 2,6-di-tert-butyl-4-cresol) or butylated hydroxyanisole (BHA). Among the benzotriazoles, those functionalized with an amine group, preferably a tertiary amine group, may be particularly suitable, such as bis(2-ethylhexyl)[(4-methyl-1H-1,2,3-benzotriazol-1-yl) methyl]amine, bis(2-ethylhexyl) [(4-methyl-2H-1,2,3-benzotriazol-2-yl)methyl]amine, bis(2-ethylhexyl) [(5-methyl-1H-1,2,3-benzotriazol-1-yl)methyl]amine, bis(2-ethylhexyl)

[(5-methyl-2H-1,2,3-benzotriazol-2-yl)methyl]amine, bis (2-ethylhexyl) [(6-methyl-1H-1,2,3-benzotriazol-1-yl) methyl]amine, or a mixture of two or more thereof. Among the diarylamines, styrenated diphenylamine may be particularly suitable.

According to an exemplary embodiment, the additive contains from 5 to 20% by weight of at least one antioxidant, for example 5 from to 10% by weight of one or more phenols and/or from 5 to 10% by weight of one or more benzotriazoles.

According to an exemplary embodiment, the additive further comprises at least one agent for increasing the ignitability. In the context of the present application, an "agent for increasing the ignitability" is understood to mean, in particular, a chemical compound capable of increasing the cetane number of a fuel, in particular a diesel fuel, and accordingly improving its ignitability, so that the fuel ignites itself more easily. Accordingly, the agent for increasing the ignitability may also be referred to as a "cetane number improver" or "cetane number booster".

Suitable examples of the agent for increasing the ignitability are (organic) peroxides and (organic) nitrates, in particular alkyl nitrates. Among the peroxides, sterically hindered peroxides may be particularly suitable, such as di-tert-butyl peroxide. Among the nitrates, branched or unbranched C6 to C10 alkyl nitrates may be suitable, such as 2-ethylhexyl nitrate.

According to an exemplary embodiment, the additive contains from 5 to 20% by weight of at least one agent for increasing the ignitability, for example from 5 to 10% by weight of one or more peroxides and/or from 5 to 10% by weight of one or more nitrates.

According to an exemplary embodiment, the additive further comprises at least one solvent. In the context of the present application, a "solvent" is understood to mean, in particular, a chemical compound that is capable of dissolving other components, in particular the imidazoline compound, and is also readily miscible with the fuel to which the additive is to be added. The solvent may also provide improved solubility of other components, in particular the imidazoline compound, in the fuel to which the additive is to be added, thus acting as a solubilizer. For this purpose, it may also be advantageous if the solvent comprises a mixture of a (relatively) polar solvent and a (relatively) apolar solvent.

According to an exemplary embodiment, the solvent comprises at least one polar solvent (or a solvent for increasing polarity) and/or at least one apolar solvent. A suitable example of a polar solvent is an alcohol, such as 2-ethylhexanol, which, moreover, may also increase the ignitability of the fuel and, due to the fact that it may be obtained from renewable raw materials, may have a positive effect on greenhouse gases without a harmful effect on the combustion gases. A suitable example of an apolar solvent is a hydrocarbon or a mixture of hydrocarbons, such as a mixture of C10 to C13 hydrocarbons.

According to an exemplary embodiment, the additive contains from 5 to 30% by weight of at least one solvent, for example from 5 to 10% by weight of at least one polar solvent and/or from 10 to 20% by weight of at least one apolar solvent.

According to an exemplary embodiment, the additive comprises at least 50% by weight (up to or ad 100% by weight) of the at least one compound of general formula (I) and further comprises at least one (one, two or all three) of the following components:

- 5 to 20% by weight of at least one antioxidant, for example 5 to 10% by weight of one or more phenols and/or 5 to 10% by weight of one or more benzotriazoles;
- 5 to 20% by weight of at least one agent for increasing the ignitability, for example 5 to 10% by weight of one or more alkyl nitrates (e.g. 2-ethylhexyl nitrate) and/or 5 to 10% by weight of one or more peroxides (e.g. di-tert-butyl peroxide);
- 5 to 30% by weight of at least one solvent, for example 5 to 10% by weight of at least one polar solvent and/or 10 to 20% by weight of at least one apolar solvent.

According to an exemplary embodiment, the additive or the additive mixture is substantially free from (of) toxic and/or carcinogenic (cancer-causing) compounds. In particular, the additive or the additive mixture may be substantially free from such substances that must be labeled as acutely toxic and/or carcinogenic according to the German Ordinance on Hazardous Substances (GefStoffV). The term "substantially free from" as used herein means in particular that the additive or the additive mixture contains less than 1% by weight, preferably less than 0.1% by weight, of such compounds and substances.

In another aspect, the present disclosure relates to the use of an imidazoline compound as described herein as a bioactive additive for a (preferably liquid) fuel.

According to an exemplary embodiment, the imidazoline compound may be used to reduce the microbial load of the fuel (in particular, to kill germs or prevent microbial infestation). Additionally, the imidazoline compound may also have an anti-corrosive effect.

In another aspect, the present disclosure relates to the use of an additive as described herein to reduce the microbial load of a fuel (in particular to kill germs) and/or to stabilize a fuel. Additionally, the additive may be used as a corrosion inhibitor.

The term "reducing the microbial load" as used herein means, in particular, that the number of (living or active) microorganisms, such as bacteria, viruses, yeasts and fungi, is reduced or microbial infestation is reduced or even avoided. To this end, the additive added to a fuel whose microbial load is to be reduced may have an antimicrobial effect or antimicrobial efficacy.

In the context of the present application, an "antimicrobial effect" or an "antimicrobial efficacy" is understood to mean the ability to kill microorganisms, such as bacteria, viruses, yeasts and fungi, or at least to control or limit their growth. According to an exemplary embodiment, in the context of the present application, an "antimicrobial effect" or an "antimicrobial efficacy" is understood to mean an antibacterial and/or antifungal effect or property, and may in particular comprise a bacteriostatic, bactericidal, fungistatic and/or fungicidal effect or property, in particular an efficacy against bacteria, yeasts and/or fungi that may occur or live in fuels.

According to an exemplary embodiment, the imidazoline compound or additive may be effective against the so-called kerosene fungus (*Hormoconis resinae* or *Amorphotheca resinae*). The kerosene fungus is a ubiquitous soil fungus that can degrade kerosene and can also survive in fuel tanks of aircraft, ships and other vehicles. There, its growth can not only cause clogging, but the fatty acids it produces can also lead to corrosion.

According to an exemplary embodiment, the imidazoline compound or additive may also be effective against other microorganisms causing a so-called diesel bug (bacteria, yeasts, molds), thereby counteracting the formation of biocorrosion and a biosludge in the fuel that may otherwise clog filters and fuel lines.

In the context of the present application, "stabilization of a fuel" means the ability to ensure the stability of a fuel over a determined period of time, for example, stability against aging and/or storage stability.

In the context of the present application, "corrosion protection" or an "anti-corrosive effect" is understood to mean the ability to slow down or prevent damage that may be caused to (for example, metallic) components by corrosion, for example, damage to tanks, pipes or other equipment for storing, transporting and/or processing fuels, including damage to an internal combustion engine and its supply lines.

According to an exemplary embodiment, the fuel is a liquid fuel (at 20° C. and 1 bar). In particular, the fuel may be selected from the group consisting of gasoline (petrol), diesel fuel, fuel oil (heating oil), heavy oil, kerosene, petroleum, and biofuels such as biodiesel.

In another aspect, the present disclosure relates to a method for reducing microbial load and/or stabilization of a fuel, the method comprising adding an additive as described herein to a fuel. In addition, the method may also provide corrosion protection.

According to an exemplary embodiment, the additive may already be added to a fuel in the refinery or before storage. Due to its low toxicity, however, the additive may also be added to the fuel by the end user himself as required.

In another aspect, the present disclosure relates to a fuel composition comprising a (preferably liquid) fuel and an additive as described herein.

According to an exemplary embodiment, the additive may be present in the fuel composition in an amount of from 100 to 5000 ppm, for example in an amount of from 200 to 4000 ppm, in particular in an amount of from 500 to 2500 ppm, based on the fuel composition. At a proportion of the additive of less than 100 ppm, the antimicrobial and/or stabilization effects may not be achieved in the desired manner. At a proportion of the additive of more than 5000 ppm, it may be that no further increase in the desired antimicrobial and/or stabilization effects is induced.

In another aspect, the present disclosure relates to a method of operating an internal combustion engine in which a fuel composition as described herein is combusted or used as fuel (or in which method an additive as described herein is added to the fuel).

According to an exemplary embodiment, the combustion engine is part of a motor vehicle, in particular an automobile (e.g. with gasoline engine or diesel engine, including a hybrid vehicle), a utility vehicle (e.g. a truck or a construction vehicle) or a motorcycle, a ship or an aircraft. In other words, the additive may be added to fuels for all kinds of means of transportation or vehicles. However, the additive may also be added to a fuel for stationary engines or added to a fuel in tanks for fuel storage.

The additive may be added during the initial filling (so-called "first fill") of vehicles, as well as regularly during the entire operating or service life of the vehicle, or even before the vehicle is not used for a longer period of time (for example, in the case of vehicles used only seasonally).

The present disclosure is further described by reference to the following examples, which, however, serve only to illustrate the teachings of the disclosure and are in no way intended to limit the scope of the present disclosure.

EXAMPLES

First Studies of Antimicrobial Efficacy

Samples Examined:

- "TUNAP new": Test solution containing 1% by weight 2-(2-heptadec-8-enyl-2-imidazolin-1-yl)ethanol additive (example according to the disclosure).
- "Standard diesel bug biocide with MBO": test solution containing 0.1% by weight of the biocide MBO (3,3-methylenebis (5-methyloxazolidine)) (comparative sample).
- "MIT": test solution containing 0.1% by weight of the biocide MIT (2-methyl-2H-isothiazol-3-one), (comparative sample).
- "Pure fuel": fuel without the addition of an additive (comparative sample)

Tested Microorganisms:

*Hormoconis resinae* ATCC 20495 ("kerosene fungus")

*Yarrowia tropicalis* ATCC 48138 ("yeast fungus")

The antimicrobial efficacy of the samples against the tested microorganisms was determined according to DIN EN 15457:2014-11.

The test results on the efficacy of the tested samples against the tested kerosene fungus are shown in FIG. 1. As can be seen from these results, the additive according to the disclosure exhibits significantly improved efficacy against the tested kerosene fungus than the conventional and also toxic biocides MBO and MIT, so that a fuel can be protected extremely effectively against germination by a kerosene fungus with the aid of the additive according to the disclosure.

Figure 2:
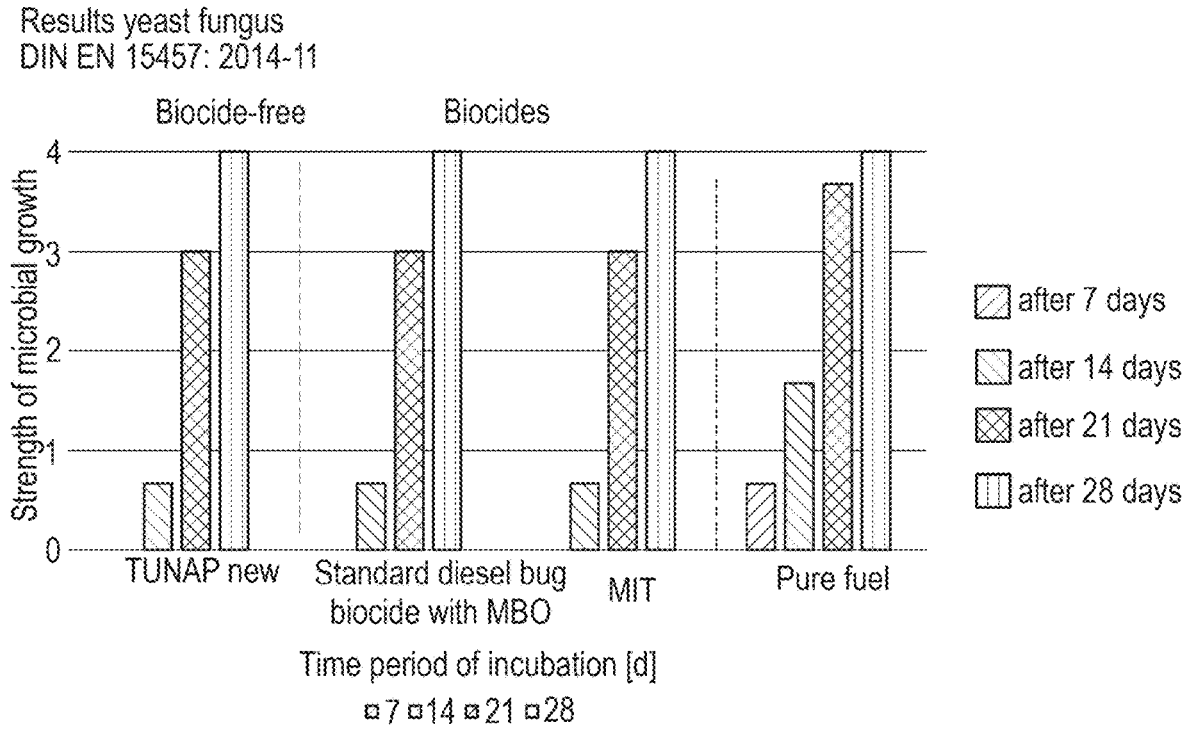
FIG. 2 shows test results on the antimicrobial efficacy of various samples tested against the yeast fungus *Yarrowia tropicalis* ATCC 48138, determined according to DIN EN 15457:2014-11.

The test results on the efficacy of the tested samples against the tested yeast fungus are shown in FIG. 2. As can be taken from these results, the additive according to the disclosure shows at least a similar efficacy against the tested yeast fungus as the conventional but toxic biocides MBO and MIT, so that a fuel can be protected against germination by a yeast fungus with the aid of the additive according to the disclosure even without toxic ingredients to the same extent as known from the prior art.

Further Studies of Antimicrobial Efficacy

Samples Examined:

- "TUNAP active ingredient": test solution containing 1000 ppm 2-(2-heptadec-8-enyl-2-imidazolin-1-yl)ethanol additive (example according to the disclosure).
- "TUNAP Protection System Diesel": test solutions containing 2000 ppm or 5000 ppm of the additive composition "1903391" described below (corresponding to approx. 1000 ppm or 2500 ppm of the active ingredient 2-(2-heptadec-8-enyl-2-imidazolin-1-yl)ethanol) (examples according to the disclosure).
- "Tunap 685 (Protezione Diesel) Biocide with MBO": test solution containing 1000 ppm of the biocide MBO (3,3-methylenebis (5-methyloxazolidine), (comparative sample).
- "BIT": test solution containing 1000 ppm of the biocide BIT (benzisothiazolinone) (comparative sample).
- "blank": fuel without addition of an additive (comparative sample)

Additive Composition "1903391":

- at least 50% by weight 2-(2-heptadec-8-enyl-2-imidazolin-1-yl)ethanol
- 10 to 20% by weight C10-C13 hydrocarbons
- 5 to 10% by weight 2,6-di-tert-butyl-4-cresol
- 5 to 10% by weight 2-ethylhexanol
- 5 to 10% by weight 2-ethylhexyl nitrate
- 5 to 10% by weight. of a mixture of bis(2-ethylhexyl)[(4-methyl-1H-1,2,3-benzotriazol-1-yl)methyl]amine, bis (2-ethylhexyl) [(4-methyl-2H-1,2,3-benzotriazol-2-yl) methyl]amine, bis(2-ethylhexyl) [(5-methyl-1H-1,2,3-benzotriazol-1-yl)methyl]amine, bis(2-ethylhexyl) [(5-methyl-2H-1,2,3-benzotriazol-2-yl)methyl]amine, bis (2-ethylhexyl) [(6-methyl-1H-1,2,3-benzotriazol-1-yl) methyl]amine Tested Microorganisms:

*Hormoconis resinae* ATCC 20495 ("kerosene fungus")

*Pseudomonas aeruginosa* DSM 15980 ("bacterium")

*Yarrowia tropicalis* ATCC 48138 ("yeast")

The antimicrobial activity of the samples against the tested microorganisms was determined according to ASTM E 1259-10.

Figure 3:
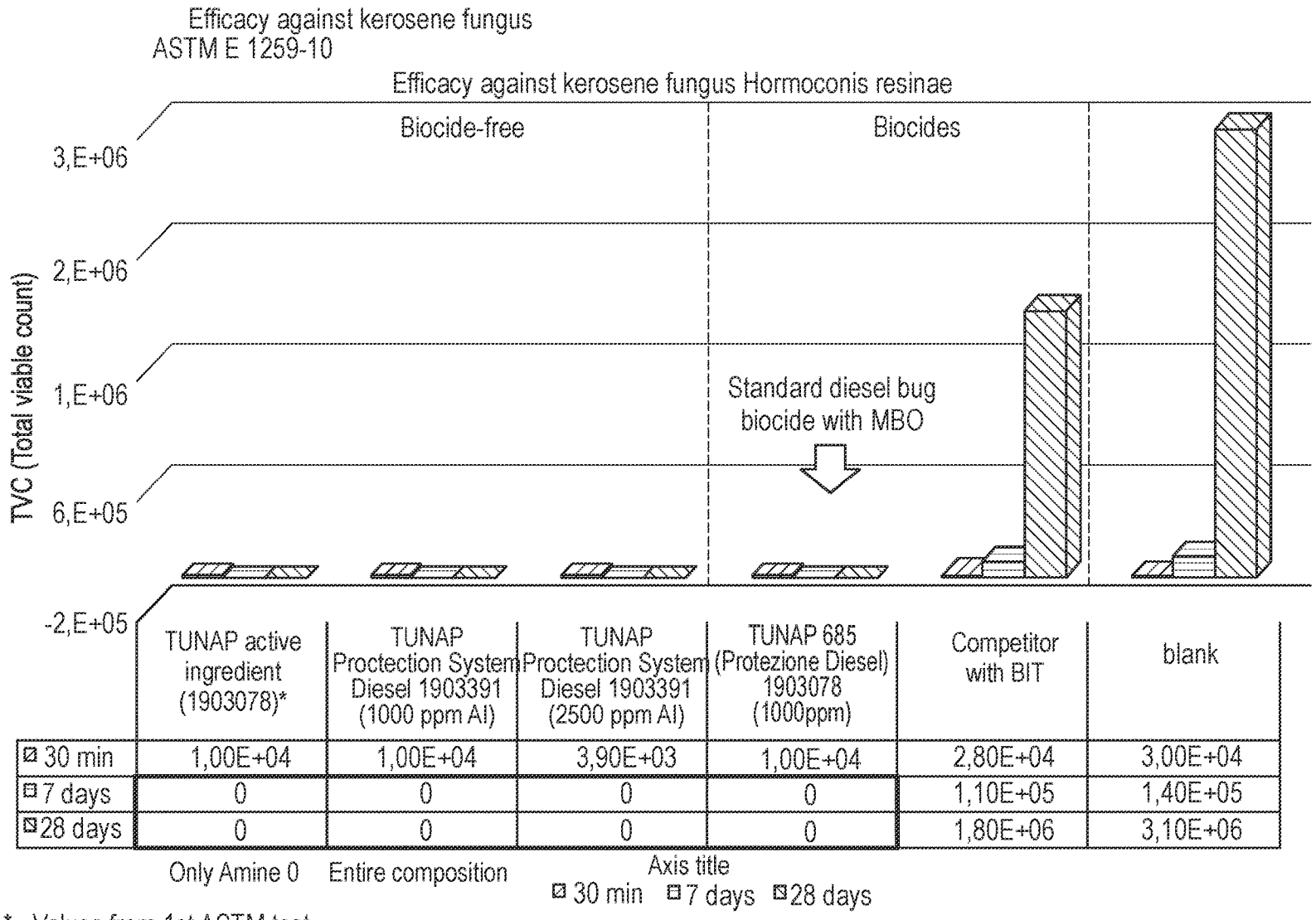
FIG. 3 shows test results on the antimicrobial efficacy of various samples tested against the kerosene fungus *Hormoconis resinae* ATCC 20495, determined according to ASTM E 1259-10.

The test results on the efficacy of the tested samples against the tested kerosene fungus are shown in FIG. 3. As can be seen from these results, the additive according to the disclosure as well as the additive composition according to the disclosure show a significantly improved efficacy against the tested kerosene fungus than the conventional biocide BIT, while no difference could be found in this method compared to the other conventional but toxic biocide MBO, since both the examples according to the disclosure and the comparative sample with MBO resulted in an almost complete killing of the tested kerosene fungus. Thus, an extremely efficient protection against germination by a kerosene fungus can be achieved with both the additive according to the disclosure and the additive composition according to the disclosure without using toxic ingredients.

Figure 4:
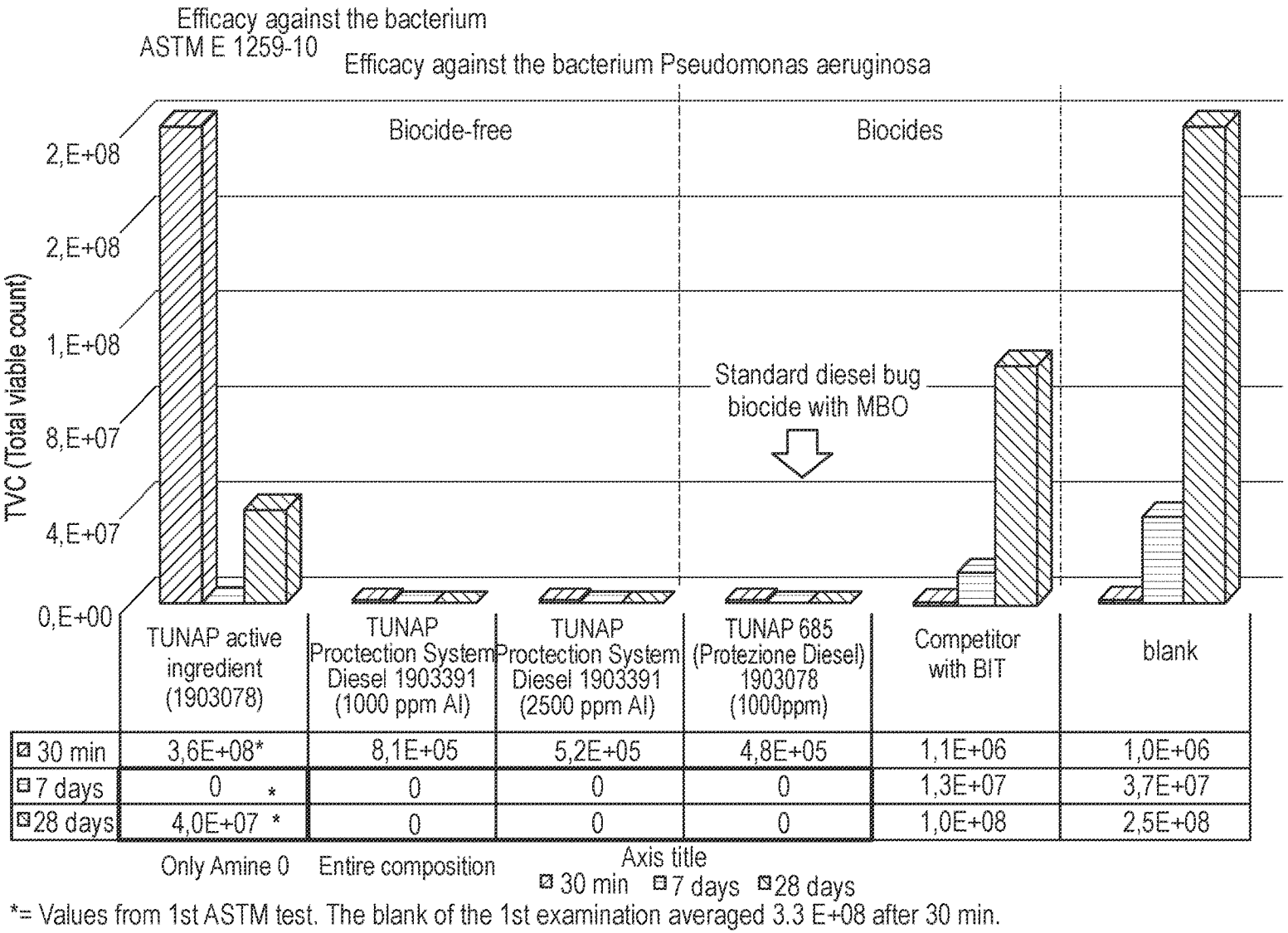
FIG. 4 shows test results on the antimicrobial efficacy of various samples tested against the bacterium *Pseudomonas aeruginosa* DSM 15980, determined according to ASTM E 1259-10.

The test results on the efficacy of the tested samples against the tested bacterium are shown in FIG. 4. As can be seen from these results, at least the additive composition according to the disclosure shows a significantly improved efficacy against the tested bacterium than the conventional biocide BIT, while in this method no difference could be found between the additive composition according to the disclosure and the other conventional but toxic biocide MBO, since both the additive composition according to the disclosure and the comparative sample with MBO resulted in an almost complete killing of the tested bacterium. Thus, at least with the additive composition according to the disclosure, an extremely efficient protection against germination by a bacterium can be achieved without using toxic ingredients.

Figure 5:
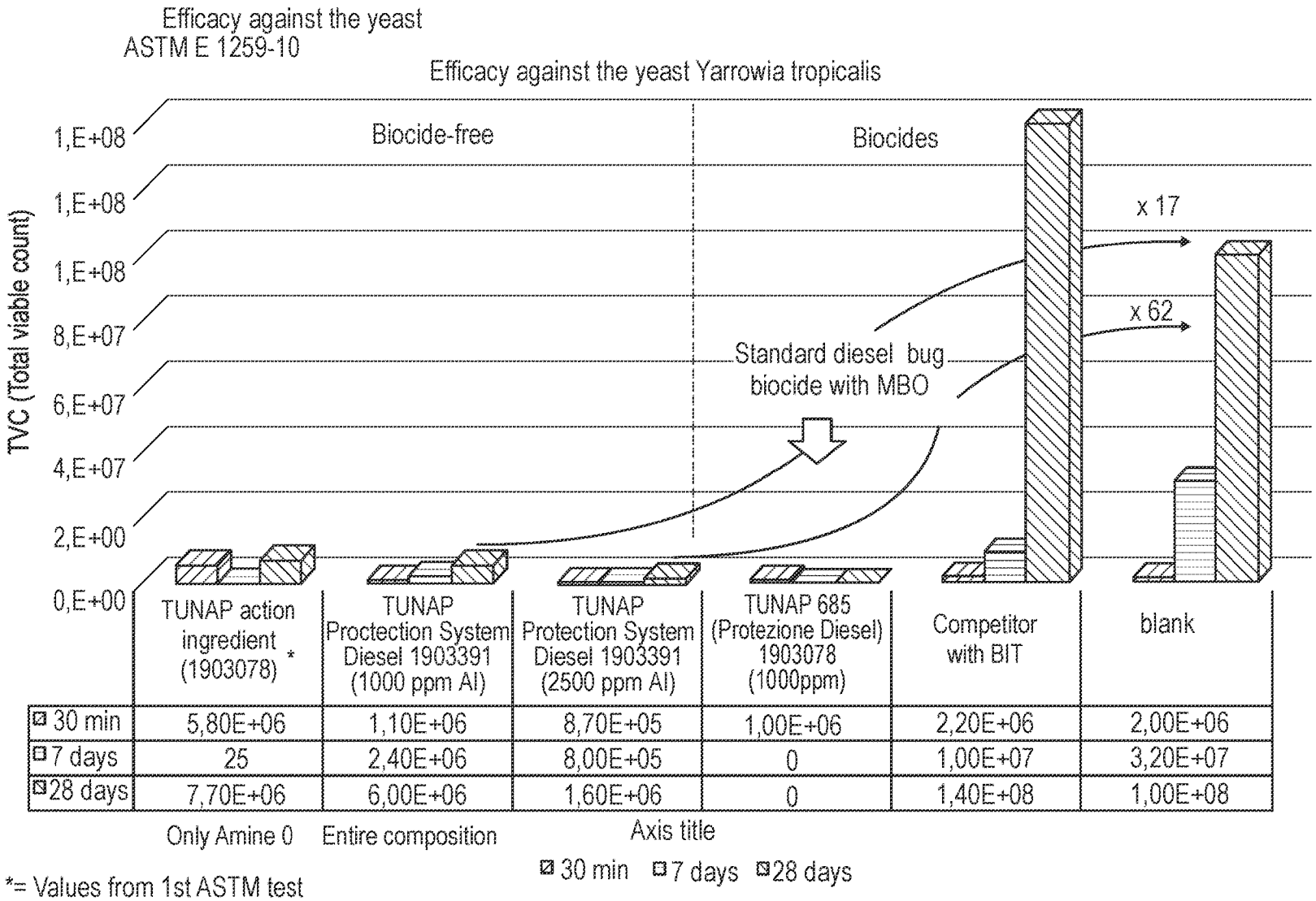
FIG. 5 shows test results on the antimicrobial efficacy of various samples tested against the yeast *Yarrowia tropicalis* ATCC 48138, determined according to ASTM E 1259-10.

The test results on the efficacy of the tested samples against the tested yeast are shown in FIG. 5. As can be seen from these results, the additive according to the disclosure, as well as the additive composition according to the disclosure, shows a significantly improved efficacy against the tested yeast than the conventional biocide BIT, while the additive composition according to the disclosure shows at least a comparable efficacy against the tested yeast as the other conventional but toxic biocide MBO. Thus, a fuel can be protected against germination by a yeast to the same extent as known from the prior art, even without toxic ingredients, with the aid of the additive composition according to the disclosure.

Test solutions with only 250 ppm, 500 ppm and 1000 ppm of the additive composition "1903391", respectively, have also shown very good efficacy against the tested microorganisms (kerosene fungus, bacterium and yeast), which proves the antimicrobial effect of the additive composition over a very wide range of applications.

The present disclosure has been described with reference to specific embodiments and examples. However, the disclosure is not limited thereto and various modifications thereof are possible without departing from the scope of the present disclosure.

The invention claimed is:

1. A bioactive additive for a fuel, wherein the additive comprises:

at least one compound represented by the general formula (I) given below:

(I)

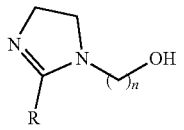

wherein

R is a saturated or unsaturated hydrocarbon residue having 14 to 20 carbon atoms; and n is an integer from 1 to 6; and a benzotriazole.

2. The additive according to claim 1, wherein R is a saturated or unsaturated hydrocarbon residue having 16 to 18 carbon atoms and n is an integer of 2 to 4.

3. The additive according to claim 1, wherein the benzotriazole is present in an amount of 5 to 20%.

4. The additive according to claim 1, wherein the additive further comprises at least one agent for increasing the ignitability.

5. The additive according to claim 1, wherein the additive further comprises at least one solvent.

6. The additive according to claim 1, wherein the additive comprises at least 50% by weight of the at least one compound of the general formula (I) and further comprises at least one of the following components:

5 to 20% by weight of at least one agent for increasing the ignitability;

5 to 30% by weight of at least one solvent.

7. The additive according to claim 3, wherein the antioxidant is selected from the group consisting of bis(2-ethylhexyl)[(4-methyl-1H-1,2,3-benzotriazol-1-yl)methyl] amine, Bis(2-ethylhexyl) [(4-methyl-2H-1,2,3-benzotriazol-2-yl)methyl]amine, Bis(2-ethylhexyl) [(5-methyl-1H-1,2,3-benzotriazol-1-yl)methyl]amine, Bis(2-ethylhexyl) [(5-methyl-2H-1,2,3-benzotriazol-2-yl)methyl]amine, Bis(2-ethylhexyl) [(6-methyl-1H-1,2,3-benzotriazol-1-yl)methyl] amine, and combinations thereof.

8. The additive according to claim 4, wherein the agent for increasing the ignitability is selected from the group consisting of alkyl nitrates and peroxides.

9. The additive according to claim 4, wherein the agent for increasing the ignitability is selected from the group consisting of 2-ethylhexyl nitrate, di-tert-butyl peroxide and combinations thereof.

10. The additive according to claim 5, wherein the solvent comprises at least one polar solvent.

11. The additive according to claim 5, wherein the solvent comprises at least one apolar solvent.

12. The additive according to claim 1, wherein the additive further comprises at least one phenol, at least one alkyl nitrate, at least one polar solvent and at least one apolar solvent.

13. The additive according to claim 1, wherein the additive comprises at least 50% by weight of the at least one compound of the general formula (I) and further comprises at least one of the following components:

5 to 10% by weight of one or more alkyl nitrates and/or 5 to 10% by weight of one or more peroxides;

5 to 10% by weight of at least one polar solvent and/or 10 to 20% by weight of at least one apolar solvent.

14. The additive according to claim 1, wherein the additive comprises 2-(2-heptadec-8-enyl-2-imidazolin-1-yl) ethanol.

15. A method for reducing microbial load and/or for stabilization of a fuel, the method comprising:

adding an additive to a fuel, wherein the additive comprises at least one compound represented by the general formula (I) given below:

(I)

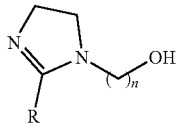

wherein

R is a saturated or unsaturated hydrocarbon residue having 14 to 20 carbon atoms; and n is an integer from 1 to 6; and a benzotriazole.

16. A fuel composition comprising a fuel and an additive, wherein the additive comprises at least one compound represented by the general formula (I) given below:

(I)

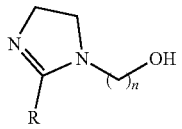

wherein

R is a saturated or unsaturated hydrocarbon residue having 14 to 20 carbon atoms; and n is an integer from 1 to 6; and a benzotriazole.

17. The fuel composition according to claim 16, wherein the additive is present in an amount of from 100 to 5000 ppm based on the fuel composition.

18. The fuel composition according to claim 16, wherein the fuel is selected from the group consisting of gasoline, diesel fuel, fuel oil, heavy oil, kerosene, petroleum, and biofuels such as biodiesel.

19. The fuel additive according to claim 16, wherein the benzotriazole is present in an amount of 5 to 20%.

* * * * *